US008230535B2

(12) United States Patent
Kik, Sr. et al.

(10) Patent No.: US 8,230,535 B2
(45) Date of Patent: Jul. 31, 2012

(54) SHOWER BASE APPARATUS

(75) Inventors: Paul S. Kik, Sr., Hudsonville, MI (US); Paul S. Kik, Jr., Grand Rapids, MI (US); James A. Wadaga, Grand Haven, MI (US)

(73) Assignee: Noble Company, Spring Lake, MI (US)

( * ) Notice: Subject to any disclaimer, the term of this patent is extended or adjusted under 35 U.S.C. 154(b) by 332 days.

(21) Appl. No.: 12/652,224

(22) Filed: Jan. 5, 2010

(65) Prior Publication Data

US 2010/0170035 A1 Jul. 8, 2010

Related U.S. Application Data

(60) Provisional application No. 61/142,947, filed on Jan. 7, 2009.

(51) Int. Cl.
*A47K 3/00* (2006.01)

(52) U.S. Cl. ..... 4/613

(58) Field of Classification Search ..... 4/596–613
See application file for complete search history.

(56) References Cited

U.S. PATENT DOCUMENTS

| | | | | |
|---|---|---|---|---|
| 2,292,368 | A | 8/1942 | Gordon | |
| 2,836,830 | A | 6/1958 | Norman | |
| 3,139,627 | A * | 7/1964 | Rice | 52/35 |
| 4,198,715 | A | 4/1980 | Daniels | |
| 4,280,613 | A * | 7/1981 | Stewart | 198/406 |
| 4,557,004 | A | 12/1985 | Piana | |
| 4,571,751 | A * | 2/1986 | Barlow | 4/288 |
| 4,844,944 | A | 7/1989 | Graefe et al. | |
| 5,140,789 | A | 8/1992 | De Gooyer | |
| 5,643,652 | A * | 7/1997 | Maurer et al. | 428/116 |
| 5,816,005 | A | 10/1998 | Han | |
| 5,845,347 | A * | 12/1998 | Young | 4/613 |
| 5,913,777 | A | 6/1999 | Gerber | |
| 6,077,613 | A | 6/2000 | Gaffigan | |
| 6,647,565 | B2 | 11/2003 | Smale | |
| D539,394 | S | 3/2007 | Luxton | |
| 2003/0003271 | A1 | 1/2003 | Bykov et al. | |
| 2007/0294954 | A1 | 12/2007 | Barrett et al. | |
| 2008/0016614 | A1 | 1/2008 | Daniels | |
| 2008/0222793 | A1 | 9/2008 | Cook | |
| 2008/0222794 | A1 | 9/2008 | Cook | |
| 2008/0222795 | A1 | 9/2008 | Cook | |
| 2008/0222796 | A1 | 9/2008 | Cook | |
| 2008/0222797 | A1 | 9/2008 | Cook | |
| 2008/0222891 | A1 | 9/2008 | Cook | |
| 2008/0276364 | A1 * | 11/2008 | Barro et al. | 4/613 |

* cited by examiner

*Primary Examiner* — Lori Baker
(74) *Attorney, Agent, or Firm* — Price Heneveld LLP

(57) ABSTRACT

A manufactured shower base assembly includes a thermoplastic honeycomb structure with a spun bond polyester fabric bonded to its base surface. The upper surface of the honeycomb structure is contoured to a desired slope and drain opening configuration, and includes a thermoplastic preformed thermoplastic waterproof membrane integrally bonded to its top surface, the membrane being contoured to conform to a shape of the honeycomb structure. A structural ring is utilized to provide added structure around the drain opening. The configuration allows for adjustment when placing/installing the shower base in relation to walls of the shower enclosure and to a floor drain in the shower enclosure, and further allows for attachment to any common clamping ring style drain, and provides for efficient and quick installation with minimization of skilled labor time.

19 Claims, 5 Drawing Sheets

SHOWER BASE APPARATUS

This application claims benefit under 35 U.S.C. §119(e) of provisional application Ser. No. 61/142,947, filed Jan. 7, 2009, entitled SHOWER BASE APPARATUS, the entire contents of which are incorporated herein in their entirety.

BACKGROUND

The present invention relates to a prefabricated shower base assembly for tile and stone applications in showers.

Tile and stone covered showers have been used for many years; however, construction methods for constructing showers and wet areas have changed dramatically such that construction of a sub-base is necessary to provide support for tile or stone floor surfaces. For example, waterproofing beneath the tile or stone is particularly necessary in multi-story constructions with living space beneath the shower area. This led to the creation/use of waterproof envelopes/barriers under the tile or stone, known as "shower pans." Early shower pans were constructed of copper, sheet metal or sheet lead, and were clamped to the drain typically with a clamping flange. These pans were then filled with a Portland cement and sand mixture, so that, when cured, they provided a base that was acceptable for bonding tile and stone. However, these types of shower pans were/are difficult and time-consuming to construct, and they were/are prone to leaking.

As new materials came into existence, better waterproofing systems evolved such as liquid and thermoplastic membranes that provided superior waterproofing characteristics and that made installation easier over traditional lead and copper pans. Although this improved the integrity of the waterproofing, it still requires skilled labor to install the mortar bed on the pan. It also requires curing of the mortar bed prior to installation of the tile or stone, which takes time and potentially leads to inefficient use of skilled manpower due to the necessity of more than one visit by the skilled workers to the installations.

As land and infrastructure costs have increased, residential homes and condominiums of multi-floor design have also increased. However, this increased density has created problems in the area of sound transmission between floors and ceilings of units above and below. The sound created by normal activity is transmitted through floors and is typically referred to as "Impact Sound." Bathrooms tend to be difficult areas to reduce the level of impact sound transmission to the unit below since a majority of bathroom areas are covered with ceramic tile or natural stone where transmission of sound through the floor becomes an issue. Since virtually all sound reduction materials are installed under the finish flooring, the area under a shower floor is not able to be isolated. Also, many bathroom "furniture" and structural articles, such as ceramic and/or metal toilets, tubs, sinks, countertops and pipes, can be sound generators and/or sound carriers, making it difficult to achieve a satisfactorily "quiet" bathroom area.

In the United States and Canada, the most common drain that is used in shower and wet area installations is the "clamping ring drain." They are typically manufactured in cast iron, PVC and ABS materials and are available from a vast number of distributors and outlets. Depending on local building codes, installation of the drain most often falls under the plumbing code. However, the responsibility for the waterproof integrity and flood testing of the installation most often lies on the plumber. This requires coordination of skilled trades, which can lead to inefficiencies and hence higher costs during installation.

Some companies have attempted to provide pre-manufactured shower bases and trays, attempting to reduce the amount of skilled labor time required for installations. However, the existing known pre-manufactured shower bases and trays do not permit adjustment in a back-to-front direction, nor in a side-to-side direction, nor diagonally, in order to match drain (and wall) locations. Floor drains also cannot be adjusted once rough-in piping is set during early stages of construction. Thus, in known systems, the floor drain must be precisely located in the shower floor relative to shower walls during building construction, and the location of the drain opening in pre-manufactured shower bases must be accurately cut to match, which is very difficult to do on a consistent basis in "real world" building constructions. Further, pre-manufactured shower bases and trays often still require repeated trips back to the installation site by skilled trades, thus still resulting in greater installation costs than desired. Still further, grout and tile are relatively brittle and very sensitive to any deflection, which leads to cracking when the floor flexes or is stressed, which in turn leads to water leak problems. Thus, rigidity and stability is very important in the supporting structure. Yet some pre-manufactured shower bases arguably provide only marginal rigidity and stability.

SUMMARY OF THE PRESENT INVENTION

A manufactured shower base assembly includes a thermoplastic honeycomb structure with a spun bond polyester fabric bonded to its base surface. The upper surface of the honeycomb structure is contoured to a desired slope and drain opening configuration, and includes a thermoplastic pre-formed thermoplastic waterproof membrane integrally bonded to its top surface, the membrane being contoured to conform to a shape of the honeycomb structure. A structural ring is utilized to provide added structure around the drain opening. The configuration allows for adjustment when placing/installing the shower base in relation to walls of the shower enclosure and to a floor drain in the shower enclosure, and further allows for attachment to any common clamping ring style drain, yet provides for efficient and quick installation with minimization of skilled labor time.

In one aspect of the present invention, a shower base assembly includes a honeycomb structure with a synthetic material bonded to its lower surface and having a contoured upper surface defining a drain opening. A formed thermoplastic waterproof membrane is supported on the honeycomb surface and has a shape matching the contoured upper surface. The waterproof membrane has an exposed surface constructed to allow tile and stone to be directly bonded to the exposed surface.

In another aspect of the present invention, a manufactured shower base includes a thermoplastic honeycomb structure with a fabric bonded to its base surface and an upper surface contoured to a desired slope and drain opening configuration. A structural ring engages the upper surface and supports portions of the honeycomb structure adjacent the drain opening. A pre-formed thermoplastic membrane is supported on the upper surface, the membrane being contoured to conform to a shape of the honeycomb structure and to drain moisture toward the drain opening. In a narrower form, the membrane forms a waterproof layer.

In another aspect of the present invention, a method of installing a shower base comprises steps of providing a manufactured shower base assembly including a thermoplastic honeycomb structure with a fabric bonded to its base surface and an upper surface contoured to a desired slope and drain opening configuration, a structural ring engaging the upper surface and supporting portions of the honeycomb structure adjacent the drain opening, and a pre-formed thermoplastic waterproof membrane supported on the upper surface, the membrane being contoured to conform to a shape of the honeycomb structure and to drain moisture toward the drain opening. The method further includes adjusting a horizontal location of the shower base assembly when placing and installing the shower base assembly in relation to walls of a shower enclosure and to a floor drain in the shower enclosure, and clamping a ring style drain to panel portions of the waterproof membrane that extend horizontally adjacent the drain opening. The method further includes installing tile and grout on the waterproof membrane to form a shower floor with drain.

These and other aspects, objects, and features of the present invention will be understood and appreciated by those skilled in the art upon studying the following specification, claims, and appended drawings.

DETAILED DESCRIPTION OF PREFERRED EMBODIMENTS

Figure 1:
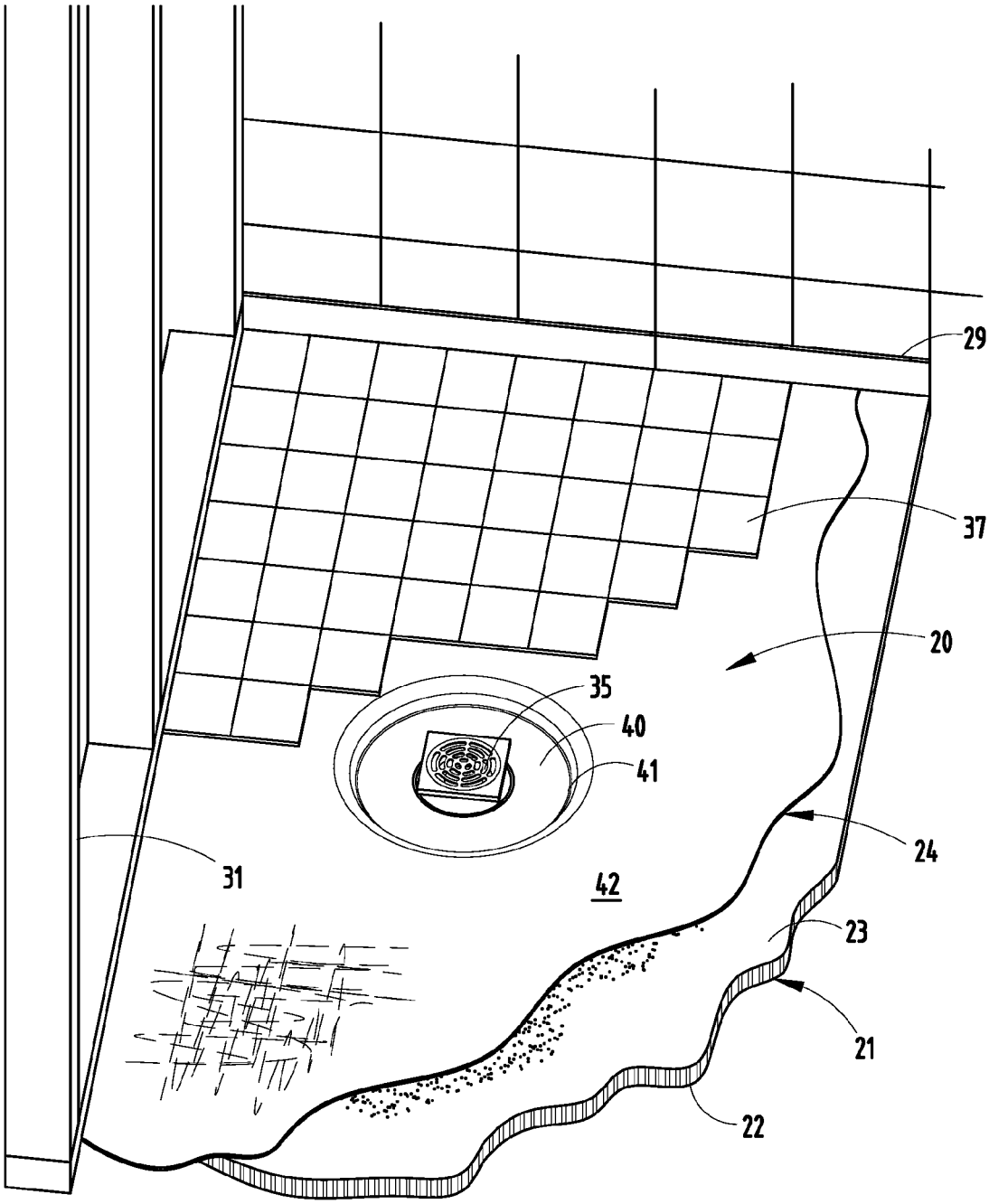
FIG. 1 a top perspective view of a shower base installation, with a portion of the tile and grout removed to better show the shower base, including connection of the shower base to the floor drain.
Figure 2:
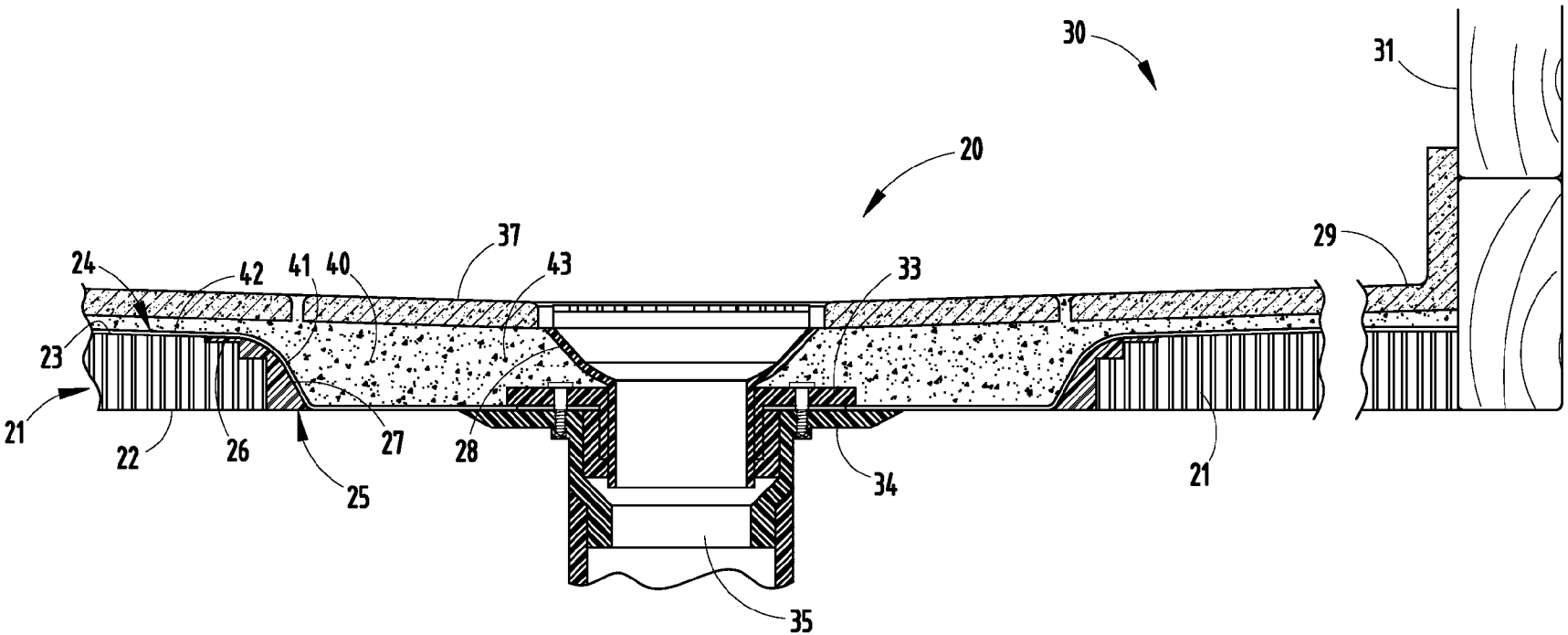
FIG. 2 is a cross-sectional view of the installation of the shower base of FIG. 1.
Figure 3:
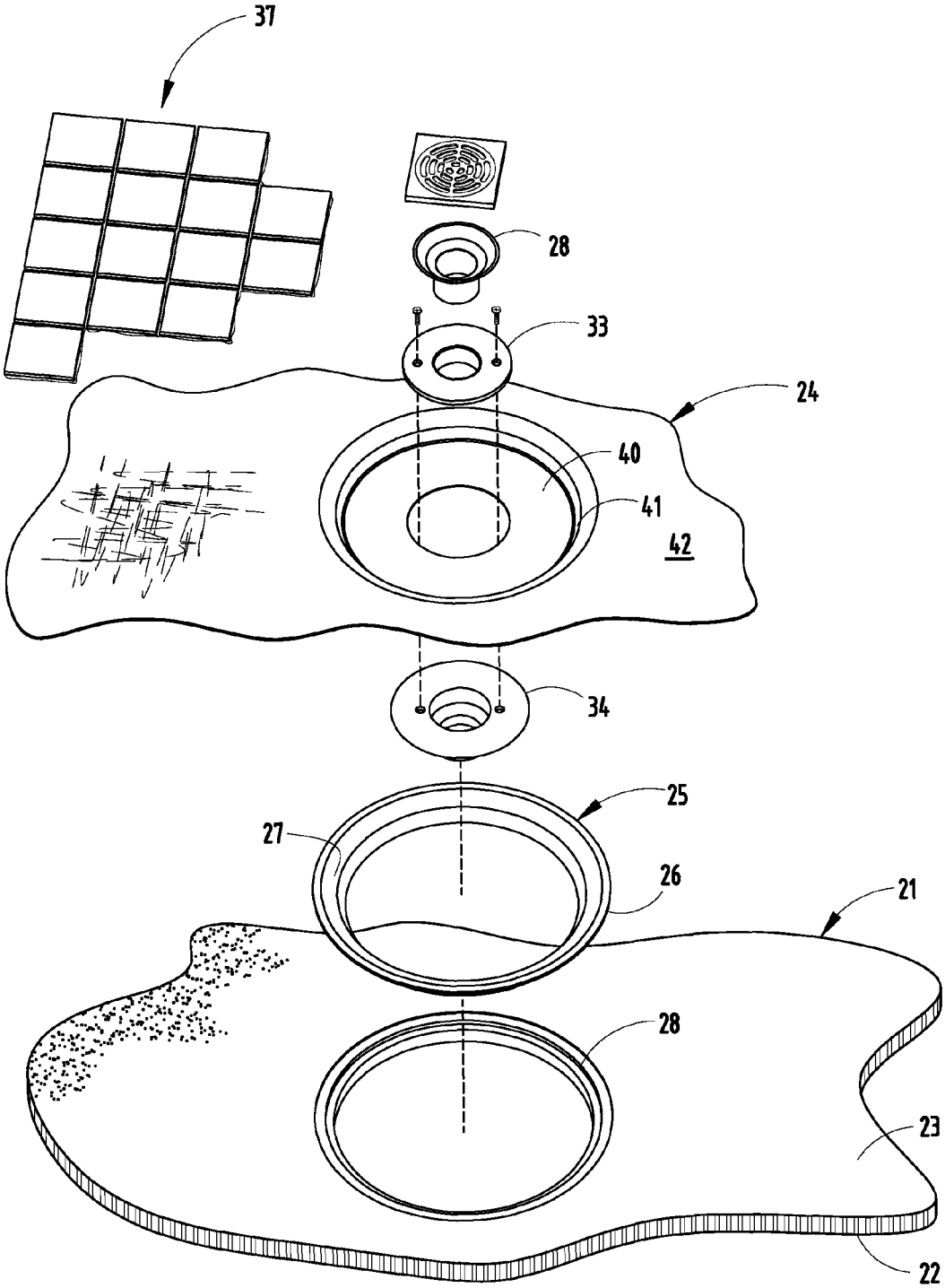
FIG. 3 is an exploded view of FIG. 1.

A manufactured shower base assembly 20 (FIG. 1) includes a thermoplastic honeycomb structure 21 with a spun bond polyester fabric 22 bonded to its base (bottom) surface. The illustrated polyester fabric has a typical tensile strength of 175 psi. The upper surface 23 of the honeycomb structure is contoured to a desired slope and drain opening configuration, and includes a thermoplastic pre-formed thermoplastic waterproof membrane 24 supported on and potentially integrally bonded to its upper surface 23. The waterproof membrane 24 is contoured to conform to a shape of the upper surface 23 of the honeycomb structure 21. A molded polymeric structural ring 25 includes a perimeter flange 26 that fits into a mating recess in the upper surface 23 of the honeycomb structure 21 and further includes a downwardly extending sleeve 27 that extends toward the drain opening 28. The structural ring 25 is utilized to provide added structure to the honeycomb structure 21 around the drain opening 28.

The configuration allows for adjustment when placing/installing the shower base assembly 20 in relation to walls 31 of the shower enclosure 30 and to a floor drain 35 in the shower enclosure 30, and further allows for attachment to any common clamping ring style drain (with upper and lower clamping members 33-34 around floor drain 35), and provides for efficient and quick installation with minimization of skilled labor time. An edge seal 29 is bonded around a perimeter of the base assembly 20 and extends up under the shower's wall board to create a natural gravitational flow for water from the shower walls 31 onto the waterproof membrane 24 and toward the drain 35. The membrane 24 includes a center depressed area defined by a recessed flat panel portion 40, and a cascading portion 41 that extends from the lightly-sloped top main portion 42 toward the panel portion 40, the cascading portion 41 generally engaging and being supported by the inner surface of the ring 25. A sand mortar mix 43 is used to fill in around the floor drain 35 so that a generally continuous surface is formed from the main portion 42 all the way to a location immediately adjacent the exposed drain hole of the floor drain. (See FIG. 1.)

The illustrated waterproof membrane 24 is thermoplastic sheet product about 40 mil thick and extruded of CPE/PVC alloy. The membrane 24 includes a polyester scrim material having a weight of at least 50 grams per square meter on its upper surface to facilitate bonding of tile and grout. For example, a suitable waterproof membrane is made by Noble Company as Noble Deck™. The waterproof membrane has a permience rating of less than 0.040 perm per ASTM standard test method E96 Method E.

The illustrated waterproof membrane 24 is made of a CPE/PVC material, and is commercially available such as from the Noble Company. It includes the following physical characteristics: Hardness ASTM D 2240-83 Shore A, Tensile Strength ASTM D 412 Die C 1450 psi, Elongation ASTM D 412 Die C 59%, Shear Strength Water Immersion 100 days ANSI 118.10-1999 PASS, Tear Strength ASTM D 624 Die C 375 psi.

The illustrated base assembly 20 has a thickness dimension at its perimeter of about 4 inches, and a slope of about ¼" per foot toward the recess for ring 25. The ring 25 (and mating recess) has an outer diameter of about 12 inches, and a depth of about 1¼". The drain opening in the honeycomb structure 21 is about 12 9/32". The honeycomb structure and waterproof membrane combine to have a compressive strength of at least about 200 psi (and preferably of 235 psi) with less than about L/720 deflection where L=a length of the shower base. Bonding of the fabric 22 and waterproof membrane 24 to the honeycomb structure provides a beam-like strength to the assembly.

Tile and grout 37 are installed onto the waterproof membrane 24 using a latex-modified thin set bonding material to provide a durable aesthetic covering. Notably, the tile and grout 37 are very very sensitive to any deflection. Thus, rigidity and stability is very important in the supporting structure, which the present shower base assembly 20 provides. Installation of the assembly 20 is also very cost-effective and efficient, thus providing advantages of pre-construction of components/assembly at a factory and much easier (and faster) install at the job site. Further, the present assembly 20 is light weight and can be trimmed at a job site if it is slightly oversized, which is another advantage.

Figure 4:
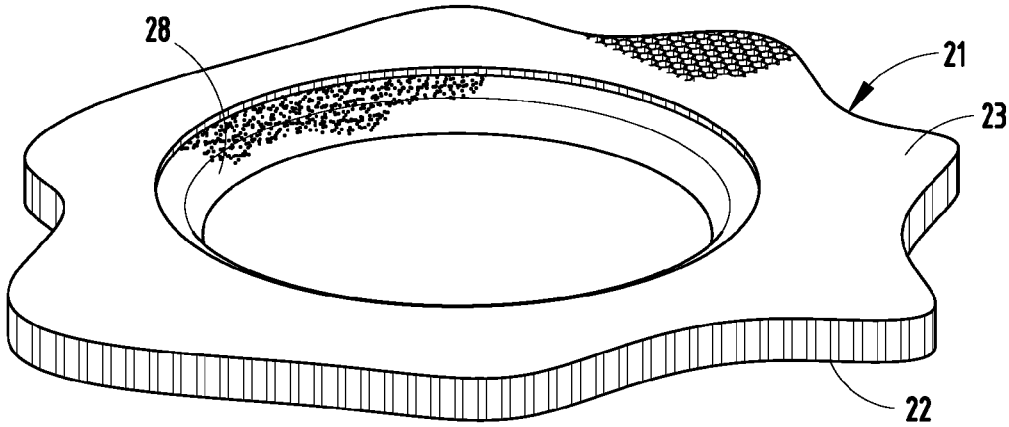
FIG. 4 is a cross-sectional view of a honeycomb blank machined/routed to a desired shape.
Figure 5:
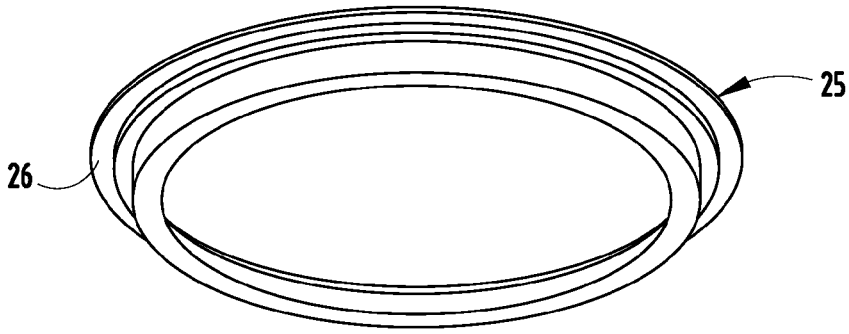
FIGS. 5-6 are perspective and cross-sectional views of the injection molded ABS plastic insert for matably setting in the ring depression in the routed honeycomb component of FIG. 4.
Figure 6:
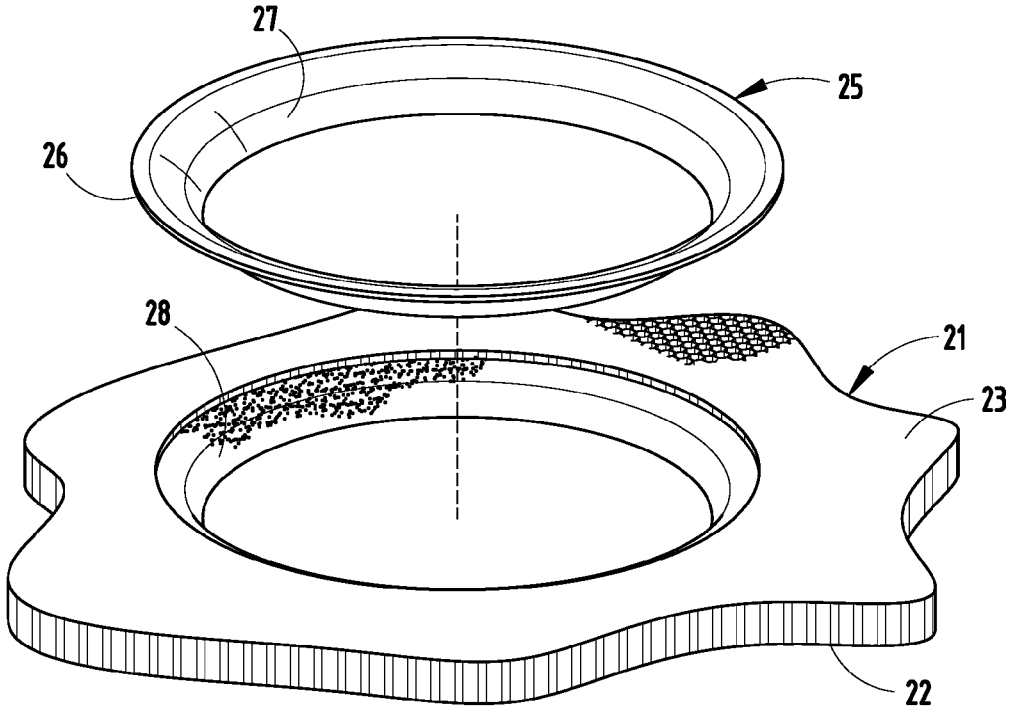
Figure 7:
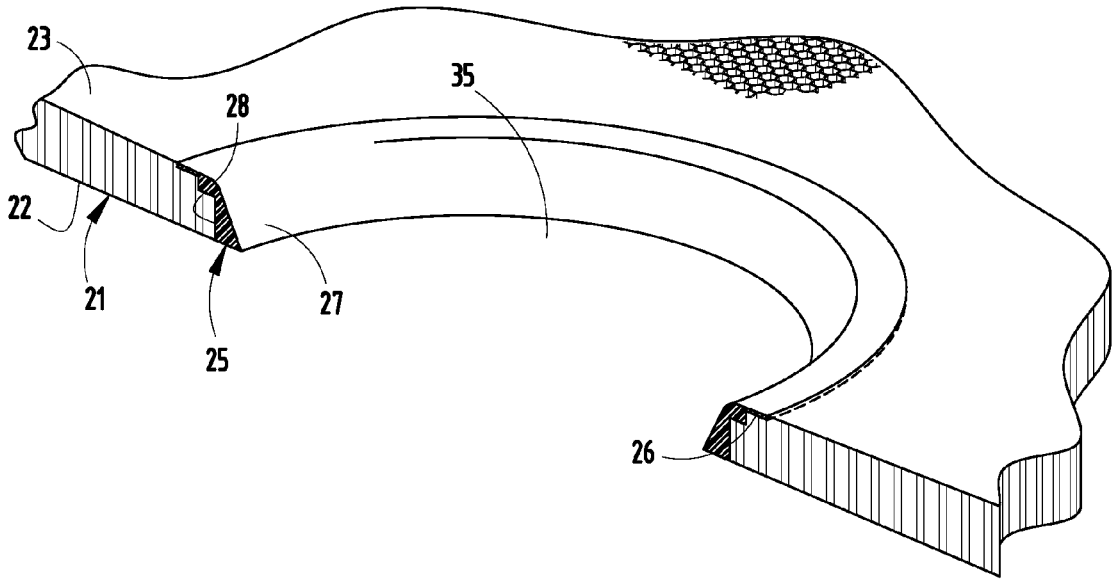
FIG. 7 is a cross-sectional view of a subassembly of the routed honeycomb component and insert from FIGS. 4-6.
Figure 8:
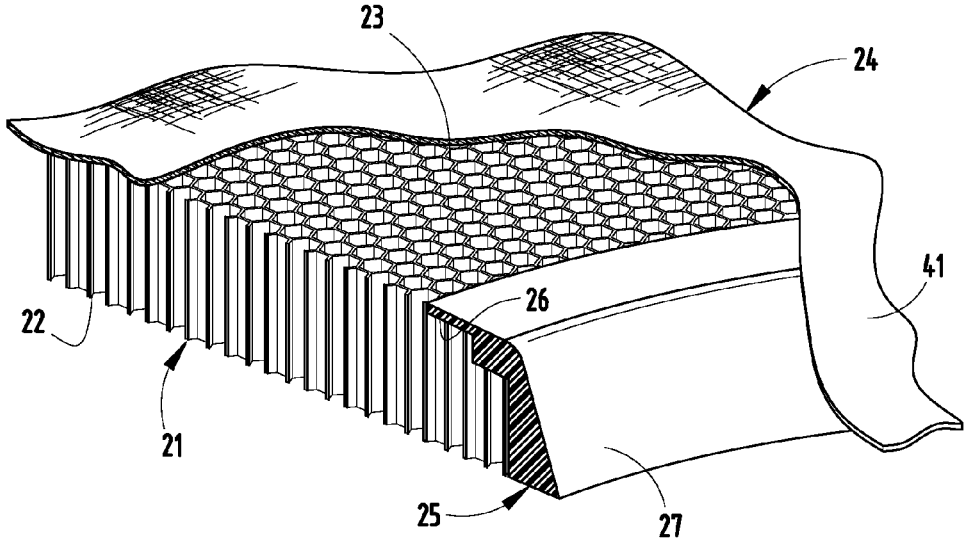
FIG. 8 is a side cross-sectional view of the subassembly of FIG. 7 including a thermoformed waterproof member with scrim attached to same.

The present shower honeycomb structure 21 (see FIG. 4) has its upper surface routed to include a drain opening 28 and routed to include a ring-shaped recess around the drain opening 28 for receiving the structural ring 25, and further routed to include a contoured top surface sloping toward the drain opening 28. An injection molded solid ring 25 of ABS material (see FIGS. 5-8) is set into the drain opening 28. A thermoformed waterproof membrane (see FIGS. 1 and 8) is placed on and bonded to the honeycomb structure 21. All this is preferably done at the factory where various dimensional changes can easily be made. At the installation, the prefabricated base assembly 20 is placed in a shower stall/enclosure 30 having a drain 35 and stud walls 31. After installation, the wall board is placed, and a seal 29 is placed at a lower edge of the wall board and bonded to the membrane 24 so that water naturally flows away from the walls 31 (down an incline) toward the drain 35.

It is contemplated that the drain opening 28 can be cut into the base assembly at the factory, and that edges of the base assembly 20 can be trimmed if necessary to facilitate tight fit of the base assembly 20 into the shower stall. However, it is contemplated that the drain opening 28 can be cut at the installation site if desired. Further, it is contemplated that the fabric 22, honeycomb structure 21, and waterproof membrane 24 will be bonded at the factory. However, it is contemplated that one or more of these components could be bonded on site using adhesives and bonding agents. The area around the drain, inside the recess in the waterproof membrane is filled with appropriate filler material as necessary to support the tile adjacent the drain cover 35.

The present assembly allows quick installation (i.e., new constructions, or retrofits/upgrades). It is particularly well suited for hotels that are being upgraded to eliminate old tubs, and to put into place showers and etc. In prior art, the upgrade construction includes a first preparation of the floor, and then waiting for a day (or more) before coming back (once or more) to finish the job.

A method of installing the shower base includes steps of providing a manufactured shower base assembly 20 including a thermoplastic honeycomb structure with a fabric bonded to its base surface and an upper surface contoured to a desired slope and drain opening configuration. A structural ring engages the upper surface and supports portions of the honeycomb structure adjacent the drain opening and a preformed thermoplastic waterproof membrane is supported on the upper surface. The membrane is contoured to conform to a shape of the honeycomb structure and to drain moisture toward the drain opening. A horizontal location of the shower base assembly is adjusted when placing and installing the shower base assembly in relation to walls of a shower enclosure and to a floor drain in the shower enclosure. A ring style drain is clamped to panel portions of the waterproof membrane that extend horizontally adjacent the drain opening and tile and grout is installed on the waterproof membrane to form a shower floor with drain.

Notably, the present pre-fabricated assembly 20 brings profit content back from installation sites to a factory, yet produces a lower cost assembly due to simplified and improved installation, including less total time required by skilled labor. The present honeycomb structure provides a very good vertical stability (i.e., less compression) than installations that utilize polystyrene foam and other foams, such that the tiles and grout have much less tendency to crack in the present base assembly 20.

Where construction criteria calls for reduced impact sound, an alternate waterproof membrane with impact sound reduction characteristics may be used in place of membrane 24. One such sound insulating membrane is Gaffigan U.S. Pat. No. 6,077,613. When used as the waterproof membrane 24, the shower base apparatus will provide a minimum ASTM 2179 sound reduction value of 12 in addition to providing adequate permience rating.

It is to be understood that variations and modifications can be made on the aforementioned structure without departing from the concepts of the present invention, and further it is to be understood that such concepts are intended to be covered by the following claims unless these claims by their language expressly state otherwise.

The embodiments of the invention in which an exclusive property or privilege is claimed are defined as follows:

1. A shower base assembly comprising:

a drain apparatus with upper and lower clamping members;

a honeycomb structure with a synthetic material bonded to its lower surface and having a contoured upper surface defining a drain opening;

a formed thermoplastic waterproof membrane supported on the honeycomb surface and having a shape matching the contoured upper surface, the waterproof membrane having an exposed surface constructed to allow tile and stone to be directly bonded to the exposed surface, the waterproof membrane including a sloped main portion and a cascading portion forming a recess in the main portion that causes water to flow to the drain opening;

a polymeric molded structural ring matingly engaging and supporting the cascading portion; and the honeycomb structure including a matching sloped portion that combines with the polymeric molded structural ring to structurally support the sloped main portion with the upper and lower clamping members clamped onto marginal material of the waterproof membrane around the drain opening.

2. The shower base assembly defined in claim 1, wherein the contoured upper surface is sloped toward the drain opening such that the waterproof membrane causes water to flow horizontally toward the drain opening.

3. The shower base assembly defined in claim 1, wherein the waterproof membrane and the synthetic material are mechanically bonded.

4. The shower base assembly defined in claim 1, including a molded insert ring bonded to the honeycomb structure to provide added support around the drain opening for the formed waterproof membrane.

5. The shower base assembly defined in claim 1, wherein the waterproof membrane has a permience rating of less than 0.040 perm per ASTM standard test method E 96 Method E.

6. The shower base assembly defined in claim 1, wherein the honeycomb structure has a thickness of at least 4.0" at an outer perimeter of the honeycomb structure.

7. The shower base assembly defined in claim 1, wherein the honeycomb structure has a geometric shape that forms a multi-sided polygonal shape.

8. The shower base assembly defined in claim 1, wherein the honeycomb structure and waterproof membrane combine to have a compressive strength of at least about 200 psi with less than about L/720 deflection.

9. The shower base assembly defined in claim 1, wherein the waterproof membrane includes a panel portion extending across the drain opening and is adapted for mechanical attachment to clamping ring drains.

10. The shower base assembly defined in claim 9, wherein the panel portion extends generally parallel the lower surface at a location where the honeycomb structure is completely cut away, the panel portion including a hole cut to match a location of a drain floor and having a perimeter portion adapted to be clampingly engaged by a clamping ring drain.

11. The shower base assembly defined in claim 1, including a synthetic material on a lower surface of the honeycomb structure that allows for bonding said lower surface to a subfloor in a shower construction.

12. The shower base assembly defined in claim 1, wherein a perimeter height of the honeycomb structure is a constant height dimension.

13. The shower base assembly defined in claim 1, including an injection molded structural ring of solid plastic material positioned in a recess in the honeycomb structure around the drain opening.

14. The shower base assembly defined in claim 13, wherein the molded structural ring includes a perimeter ring portion extending into a mating recess in the contoured upper surface of the honeycomb structure and further includes a sleeve ring portion that extends downwardly toward the drain opening.

15. The shower base assembly defined in claim 1, wherein the synthetic material on the honeycomb structure is a scrim material.

16. The shower base assembly defined in claim 1, wherein the honeycomb structure includes a plurality of walls that extend vertically between the lower surface and the contoured upper surface, and when cross-sectioned horizontally, define a plurality of interconnected honeycomb shapes.

17. The shower base assembly defined in claim 1, including a drain hold formed by the waterproof membrane, and lower clamping components clamped onto the waterproof membrane around the drain hole.

18. A method of installing a shower base, comprising steps of:

providing a manufactured shower base assembly including a thermoplastic honeycomb structure with a fabric bonded to its base surface and an upper surface contoured to a desired slope and drain opening configuration, a structural ring engaging the upper surface and supporting portions of the honeycomb structure adjacent the drain opening, and a pre-formed thermoplastic waterproof membrane supported on the upper surface, the waterproof membrane including a sloped main portion and a cascading portion forming a recess in the main portion that causes water to flow to the drain opening, and the structural ring matingly engaging and supporting the cascading portion; the membrane being contoured to conform to a shape of the honeycomb structure and the cascading portion to drain moisture toward the drain opening;

adjusting a horizontal location of the shower base assembly when placing and installing the shower base assembly in relation to walls of a shower enclosure and to a floor drain in the shower enclosure;

clamping upper and lower clamping members onto marginal material of the waterproof membrane around the drain opening; and installing tile and grout on the waterproof membrane to form a shower floor with drain.

19. The shower base assembly defined in claim 1, including mortar mix filing the recess with the tile covering the main portion and also covering a top of the mortar mix in the recess to an area adjacent the drain opening.

* * * * *